US005085123A

United States Patent [19]

Rossel et al.

[11] Patent Number: 5,085,123

[45] Date of Patent: Feb. 4, 1992

[54] LARGE-CALIBER GUNS

[75] Inventors: Ulf Rossel, Granbergsdal; Mats Karlsson; Johan Ternsjö, both of Karlskoga, Sweden

[73] Assignee: Aktiebolaget Bofors, Bofors, Sweden

[21] Appl. No.: 520,224

[22] Filed: May 9, 1990

[30] Foreign Application Priority Data

May 9, 1989 [SE] Sweden ..... 8901626

[51] Int. Cl.[5] ..... F41A 15/10

[52] U.S. Cl. ..... 89/4.2; 89/24; 89/138; 89/164; 89/181; 89/186; 89/198

[58] Field of Search ..... 89/4.05, 4.2, 22, 24, 89/47, 138, 164, 181, 186, 187.01, 198

[56] References Cited

U.S. PATENT DOCUMENTS 4,730,539 3/1988 Hallqvist ..... 89/24
4,777,862 10/1988 Hallqvist ..... 89/24

FOREIGN PATENT DOCUMENTS 468063 6/1914 France ..... 89/4.05

OTHER PUBLICATIONS

Smith et al, The Book of Rifles, 1948, pp. 590-591, "breech" and "breechblock".

*Primary Examiner*—Stephen C. Bentley
*Attorney, Agent, or Firm*—Pollock, Vande Sande & Priddy

[57] ABSTRACT

A device used especially in a large caliber weapon for controlling the train of motion of an ammunition unit during the ramming thereof in the weapon, and of the case of the ammunition unit on firing of the gun includes an impact arrangement which upon ramming of the ammunition unit enter into interaction with and retard the ammunition unit. An energy storing device is chargeable through the impact with kinetic energy existing in the retarding ammunition unit. In response to energy transmitted from the energy storing device the closing of the breech block is activated. The breech block in the closed position retains the case of the ammunition unit during the firing and during a predetermined portion of the rearwardly directed movement in the gun effected on firing. The impact arrangement includes an impact member interactable with a flange on the case and displaceable in the longitudinal direction of the gun, and an impact spring means interactable with the impact member and with an impact piston.

17 Claims, 1 Drawing Sheet

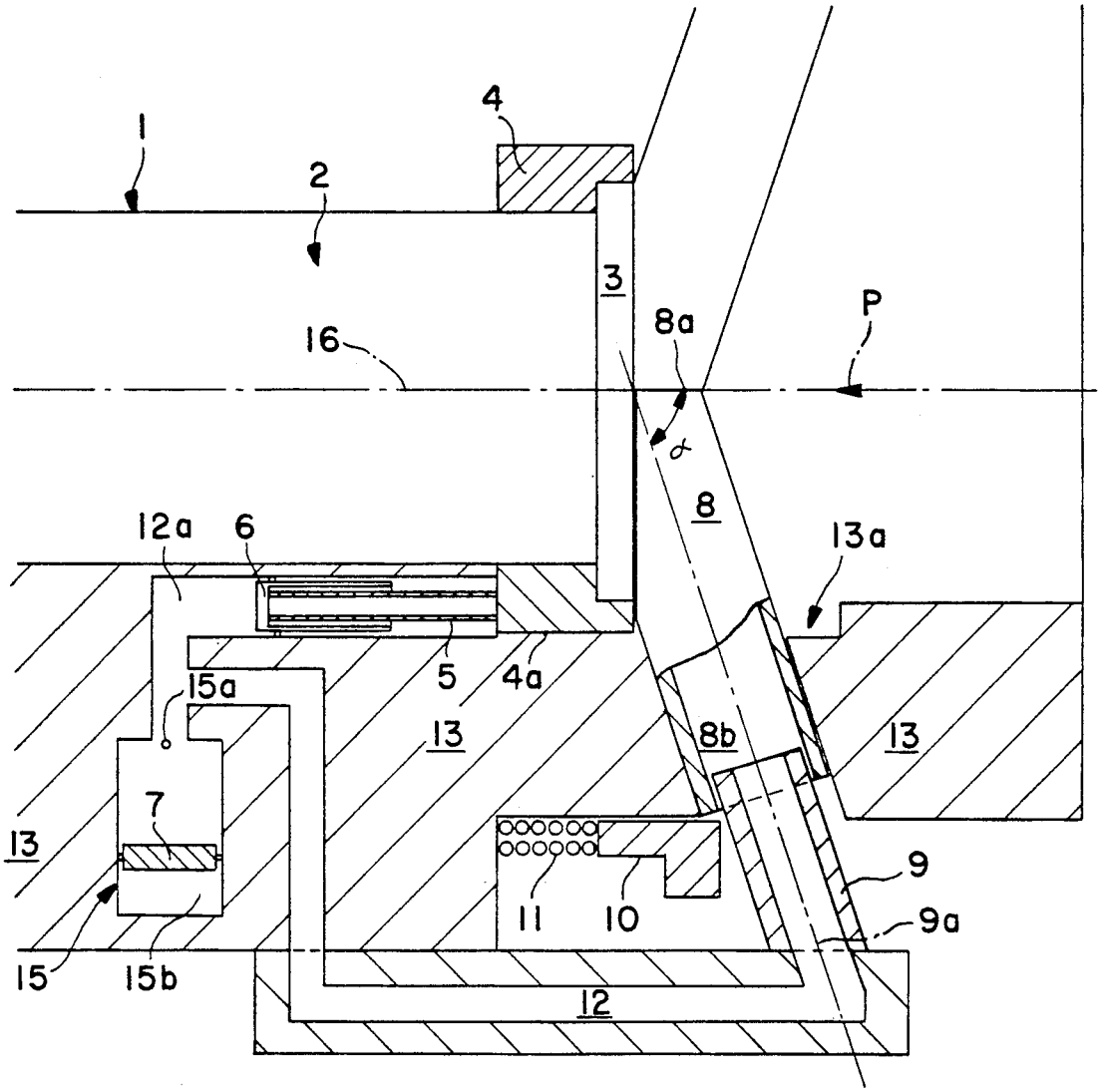
1
2
4
3
8a
P
16
α
8
12a
6
13a
5
4a
15a
13
8b
13
7
13
9
11
10
9a
15
15b
12
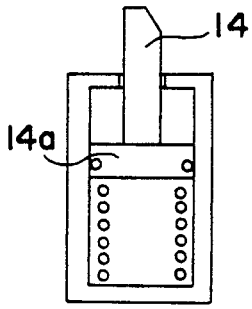
14
14a

LARGE-CALIBER GUNS

TECHNICAL FIELD

The present invention relates to a device for controlling the train of motion in a large-caliber gun both for an ammunition unit, for example, in the form of a cartridge, during the ramming thereof in the gun, and for the case of the ammunition unit as the gun is being fired and the spent case of the ammunition unit after firing. The term large-caliber gun is understood in the present context to mean, for example, a gun with a caliber of 25 cm. The present invention is nevertheless also applicable to guns with appreciably smaller calibers, for example 30 mm.

BACKGROUND OF THE INVENTION

Guns with automatic loading devices are previously known in this art. In such devices, the round/cartridge is rammed into the ramming position, whereafter the breech mechanism screw, etc. and the like, is closed. When this has been done the gun can be fired and, upon firing, the rearwardly directed motion performed by the movably journalled part of the gun relative to its cradle (the recoil jacket) or the like may be utilized for ejection of the spent cartridge case.

High demands have been imposed on present day guns as regards rate of fire. High ramming velocities, for example ramming velocities of 100 m/s, must be used, resulting in bounce problems on ramming. Similarly, ejection of spent cartridge cases must be performed rapidly and effectively. It is also required that the trains of motion to be controllable with relatively small masses and forces.

SUMMARY OF THE INVENTION

The object of the present invention is to provide a device that solves the problems outlined above and has a structure including among other things, impact means which, on ramming of the ammunition unit, enter into interaction with and retard the ammunition unit and a pressure accumulator is chargeable via the impact means with existing kinetic energy in the thus retarding ammunition unit. Further characteristics are that the breech function (or corresponding function) of the gun is actuatable for closing of the breech or the like by means of the energy stored in the pressure accumulator and that the breech block mechanism or equivalent, during its activation by means of the stored energy, causes retention of the case of the ammunition unit during the firing and during a predetermined portion of the rearward directed motion in the barrel that occurs in consequence of firing.

The impact means preferably comprise an impact ring member interactable with a flange on the case and displaceable in the longitudinal direction of the gun relative to the gun, and one or a plurality of impact spring means interactable with the impact ring member and a piston designated as impact piston. The impact means are preferably connected to the pressure accumulator and, depending on the kinetic energy in the ammunition unit, supply the pressure accumulator with its energy by displacement of the impact piston against the action of a spring, for example a gas spring, which is closed in by a floating piston. In one embodiment of the device according to the invention the pressure accumulator, via its pressure side, is communicable or connected with the breech function or the equivalent function which then encompasses a piston function (breech piston) which is actuable by the energy stored in the pressure accumulator on the activation for closing of the breech.

In one embodiment the breech block in a starting position, is mechanically actuated for retention in its open position by means of the impact member. Upon actuation of the impact member in relation to the gun otherwise by means of the ammunition unit to a predetermined longitudinal displacement position, the breech block is mechanically released and activated towards its closing position by means of the energy stored in the pressure accumulator. In the closed position a breech locking member enters into function for retention of the breech block in its closed position so as to completely assure full safety against opening of the breech during firing.

In yet a further embodiment the breech block is arranged to receive actuation force on firing of the gun on account of the rearward directed acceleration movement in the weapon. This actuation force endeavours to influence the breech block towards its open position. At a predetermined longitudinal displacement position for the recoiling portion of the weapon relative to the fixed portion thereof (the recoil jacket) an arrest means enter into interaction with the breech block locking means so that the breech is mechanically released and can perform its opening movement. The arrest means is preferably controlled by the gas pressure in the weapon. During the breech opening movement the breech piston function accomplishes a pressure-raising influence on the impact piston against the action of the impact spring. The latter is then tensioned and can be utilized on exposure of the case by the breech block to impart to the case an acceleration force for its ejection from the weapon via the opened breech.

In yet another embodiment, the present invention is characterized in that the ammunition unit is retarded in a controlled and accurate manner despite the high ramming velocity, for instance a ramming velocity of 100 m/s. It may be deemed yet a further characterizing feature that the ammunition unit will be effectively blocked in a short time and by means of relatively small masses and forces. Moreover, releasing of the blocking of the cartridge case after firing may be accomplished in a short time and with relatively small masses and forces. The spent cartridge case may then attain a high velocity on its departure from the gun.

By means of the invention the ramming speed may be substantially increased as compared to previous ramming velocities. One estimate of the increase in ramming velocity indicates that it is possible to increase ramming velocities by about 500 per cent. Blocking of the cartridge or equivalent can take place in as short a time as about 3 ms. The blocking is accomplished with small masses and small forces. The release of the blocking can take place within approximately 3 ms and with small masses and forces. The spent cartridge case can be accelerated to a velocity of 150 m/s during ejection thereof.

BRIEF DESCRIPTION OF THE ACCOMPANYING DRAWINGS

One currently proposed embodiment of a device displaying the characterizing features of the present invention will be described in greater detail below with reference to the accompanying Drawing in which;

The FIGURE is in the form of a diagram and in longitudinal section illustrates the relevant parts of a piece of ordnance.

DESCRIPTION OF PREFERRED EMBODIMENTS

The reference numerals in the FIGURE designate the following parts:

1. Chamber
2. Cartridge
3. Case flange
4. Impact ring
5. Impact spring
6. Impact piston
7. Pressure accumulator
8. Breech block
9. Breech piston
10. Breech locking clamp/breech locking means
11. Breech locking spring
12. Connection pipe/connection duct
13. Breech-barrel
14. Arrest boss with piston
15. Pressure accumulator cavity
16. Bore line

DETAILED DESCRIPTION OF THE PREFERRED EMBODIMENT(S)

The cartridge may be configured in a known manner and may consist of a case with a case flange 3, propellant charge and projectile/shell. The projectile may consist of a full-caliber projectile or of a sub-caliber projectile. The case as such may be of several different configurations with varying or constant conicity in a known manner. The cartridge can be rammed into the chamber (the position shown in the FIGURE) by means of free flight during the final portion of the ramming path. The cartridge may also be rammed using only a rammer or using a rammer and ramming head throughout the entire ramming procedure. The ramming motion may be more or less controlled, partly before and partly during the ramming procedure.

The breech 13 and the barrel may consist of an integrated, non-divisible unit manufactured of one and the same material or made of several different materials (composite) or consist of different divisible units manufactured of the same material or made of several different materials (composite). The chamber may be located solely in the barrel, solely in the breech or in both the barrel and the breech. The invention will now be described solely on the basis of the first-mentioned embodiment.

The cartridge 2 is shown in the rammed position and has thus moved in an axial direction towards the chamber 1, see arrow P. The case flange 3 comes into contact, towards the end of the ramming path of the cartridge, with the axially movable impact ring member 4. The latter has been allocated a recess 13*a* in the breech. The impact ring is shown in its one end position to which it has been actuated by the cartridge on account of the kinetic energy contained therein. While moving from the second end position determined by the recess 13*a* to the end position illustrated in the FIGURE the impact ring and the cartridge maintain the same velocity. During the thus obtained movement of the impact ring the spring 5 is compressed, which accelerates the impact piston 6. The impact piston 6 acts on a medium, for example hydraulic fluid. The hydraulic fluid behind the piston at 12*a* receives a pressure increase on account of the acceleration of the impact piston. The pressure accumulator piston 7 is also accelerated since the cavity 15 for the pressure accumulator is connected to the connection 12 via an aperture 15*a*. On acceleration of the pressure accumulator piston 7 a more compressible medium is compressed in that portion 15*b* of the cavity 15 which is located on the other side of the piston 7. The medium in the cavity 15*b* may consist of gas.

Prior to commencement of the ramming cycle the impact ring 4 and impact piston 6 with the spring 5 are in protracted positions in accordance with the foregoing. The impact ring assumes its other end position, such which the breech block 8 is arrested in that its front 8*a* is at rest and blocked in the open position against the outer periphery 4*a* of the impact ring 4. During the very last stretch of the ramming path the breech block 8 will be released from the impact ring 4 and consequently the breech block 8 will be accelerated towards its closing position. The force required to accelerate the mass of the breech block is obtained from the pressure in the hydraulic medium contained in the connection 12, 12*a*. The piston is designed with an inner duct which communicates with the duct 12 and with an inner cavity 8*b* in the breech block. When the breech block 8 has reached its closing position as illustrated in the FIGURE a breech locking clamp/breech locking means 10 is moved by the force from a breech locking spring 11 behind the breech block and blocks it in its closed position in accordance with the FIGURE. The gun is now ready to be fired. On firing, the barrel and breech block in the gun will accelerate axially rearwards and be retarded by a recoil brake device in a known manner. An arrest boss 14 with piston 14*a* is in communication with and is operated by the pressure in the barrel in a similarly known manner located in the recoil jacket will give impact against the breech locking means 10. The spring 11 will then again be compressed, causing the breech block 8 to be released and able to move towards its opening position.

The breech block 8 is disposed in such a manner as to move in a plane (at right angles to the flat plane shown in the FIGURE) radially towards the axial plane of the cartridge and thus also of the chamber (a right angles to the flat plane shown in the FIGURE) at an angle $\alpha$ which is less than 90°. During firing the breech block 8 will thus be exposed to both axial and radial force. Depending on the angle $\alpha$ selected, the force in the axial and radial directions may assume a different value. If the angle $\alpha$ is selected to be substantially 90° substantially less than 90° the breech will be self-inhibiting. If the angle $\alpha$ is selected to be not insignificantly less than 90° (for example up to approx. 60°) the breech, under the influence of the force generated on firing, will endeavour to open itself. The embodiment illustrated in the FIGURE utilizes this known fact. As the breech 8 proceeds towards its fully opened position the hydraulic medium in 8*b*, 9*a*, 12, 12*a* and 15*a* will again be compressed and accomplish a pressure rise through the pressure accumulator. When the breech block subsequently reaches or almost reaches its fully opened position the impact piston 6 will have compressed the spring 5 so that the impact ring 4 can actuate the case flange 3 with an axially rearwardly directed force with the aid of which the spent cartridge case leaves the chamber.

Depending upon the point in time selected for the breech block 8 to open, it is possible to choose what influence the barrel pressure may be permitted to exercise on the ejection procedure. This influence may be allocated different values depending on the setting position (setting value) of the arrest boss 14 with the piston 14*a*. In the embodiment described heretofore use is preferably made of a breech block or of several coacting breech block mechanism parts 8, one impact ring 4, two or more impact pistons 6 and two or more arrest bosses 14 with associated pistons 14*a*. The present invention may be realized in the form of a completely mechanical device, a hydraulic device or in analogy with the embodiment described above as a combined hydraulic and mechanical device.

The present invention should not be considered as restricted to that described above and shown on the Drawing by way of example, many modifications being conceivable without departing from the spirit and scope of the appended claims.

What we claim and desire to secure by Letters Patent is:

1. A device used in a weapon for controlling the train of motion partly of an ammunition unit during the ramming thereof in the weapon, and partly of the case of the ammunition unit on firing of the gun, said device comprising:

impact means adapted upon ramming of the ammunition unit, for interacting with and retarding the ammunition unit;

an energy storing means chargeable through said impact means with kinetic energy existing in the retarding ammunition unit;

means responsive to said energy tranmitted from said energy storing means for activating closing of a breech block;

wherein said breech block, during its activation to its closed position is adapted to retain the case of the ammunition unit during said firing and during a predetermined portion of the rearwardly directed movement in the gun occasioned by firing; and wherein said impact means includes an impact member interactable with a flange on the case and displaceable in the longitudinal direction of the gun, and an impact spring means interactable with said impact member and with an impact piston.

2. The device as claimed in claim 1, wherein said energy storing means is a pressure accumulator.

3. The device as claimed in claim 2, wherein said impact means are connected to said pressure accumulator and, depending on said kinetic energy in the ammunition unit, supply said pressure accumulator with its energy by displacement of said impact piston against the action of a spring.

4. The device as claimed in claim 3, wherein said pressure accumulator, through its pressure side is connected to said responsive means including a breech piston which is exposable to said energy stored in said pressure accumulator upon said activation for closing of said breech block.

5. The device as claimed in claim 3, wherein said breech block, in a starting position, is retained in its opened position by means of said impact member wherein upon actuation of the impact member to a predetermined longitudinal displacement position with respect to the rest of the gun, by means of the ammunition unit the breech block is released and activated towards its closing position by said means responsive to said energy stored in said pressure accumulator; and wherein in the closed position of the piston a breech locking means enters retentions said breech block in its closed position.

6. The device as claimed in claim 1, wherein the ammunition unit is retarded in a controlled and accurate manner despite a high ramming velocity.

7. The device as claimed in claim 1, wherein the ammunition unit is blocked effectively and in a short time and by means of relatively small masses and forces.

8. The device as claimed in claim 1, wherein release of the blocking of the case after firing takes place in a short time and with relatively small masses and forces.

9. The device as claimed in claim 1, wherein a high velocity is imparted to the spent case upon its departure from the gun.

10. A device used in a weapon for controlling the train of motion partly of an ammunition unit during the ramming thereof in the weapon, and partly of the case of the ammunition unit on firing of the gun, said device comprising:

impact means adapted, upon ramming of the ammunition unit, for interacting with and retarding the ammunition unit, said impact means including an impact member for interconnecting with the ammunition means and means for transmitting kinetic energy existing in the retarding ammunition unit;

an energy storing means being chargeable with said kinetic energy through said energy transmitting means of said impact means;

means responsive to energy transmitted from said energy storing means for activating closing of a breech block;

wherein said breech block, during its activation to its closed position is adapted to retain the case of the ammunition unit during said firing and during a predetermined portion of the rearwardly directed movement in the gun occasioned by firing.

11. The device as claimed in claim 10, wherein said impact member is interactable with a flange on the case and displaceable in the longitudinal direction of the gun, and said energy transmitting means includes an impact spring and an impact piston, said impact spring being interactable with said impact member and with said impact piston.

12. The device as claimed in claim 11, wherein said energy storing means is a pressure accumulator.

13. The device as claimed in claim 12, wherein said breech block, in a starting position, is retained in its opened position by means of said impact member wherein upon actuation of the impact member to a predetermined longitudinal displacement position with respect to the rest of the gun, by means of the ammunition unit the breech block is released and activated towards its closing position by said means responsive to said energy stored in said pressure accumulator; and wherein in the closed position of the piston a breech locking means enters retentions said breech block in its closed position.

14. The device as claimed in claim 13, wherein said breech block is disposed to receive actuation force upon firing of the gun on account of the rearwardly directed acceleration movement in the gun, which actuation force urges the breech block towards its open position; wherein at a predetermined longitudinal displacement for the recoiling portions of the gun with respect to the fixed parts thereof, an arrest boss controlled by the gas pressure in the gun is released and performs its opening movement; and wherein a breech block piston, during the opening movement, exerts a pressure-raising influence on said impact piston against the action of said impact spring, whereupon, on release of the case by the breech, the impact spring imparts to the case a force of acceleration for its ejection from the weapon via the opened breech.

15. The device as claimed in claim 12, wherein said pressure accumulator, through its pressure side is connected to said responsive means including a breech piston which is exposable to said energy stored in said pressure accumulator upon said activation for closing of said breech.

16. The device as claimed in claim 10, wherein said energy storing means is a pressure accumulator.

17. The device as claimed in claim 16, wherein said pressure accumulator, through its pressure side is connected to said responsive means including a breech piston which is exposable to said energy stored in said pressure accumulator upon said activation for closing of said breech block.

* * * * *